US011248796B2

(12) United States Patent
Kamoi et al.

(10) Patent No.: US 11,248,796 B2
(45) Date of Patent: Feb. 15, 2022

(54) GAS TURBINE ENGINE

(71) Applicant: HONDA MOTOR CO., LTD., Tokyo (JP)

(72) Inventors: Yasuhara Kamoi, Wako (JP); Hiroshi Sawamura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/802,738

(22) Filed: Feb. 27, 2020

(65) Prior Publication Data

US 2020/0284433 A1 Sep. 10, 2020

(30) Foreign Application Priority Data

Mar. 7, 2019 (JP) ..... JP2019-041206

(51) Int. Cl.
*F23R 3/54* (2006.01)
*F23R 3/60* (2006.01)

(52) U.S. Cl.
CPC . *F23R 3/54* (2013.01); *F23R 3/60* (2013.01)

(58) Field of Classification Search
CPC .... F23R 3/54; F23R 3/60; F23R 2900/00005; F01D 9/02; F01D 9/023; F02C 7/20
See application file for complete search history.

(56) References Cited

U.S. PATENT DOCUMENTS 5,289,677 A * 3/1994 Jarrell ..... F23R 3/60 60/752
6,916,154 B2 7/2005 Synnott
7,950,233 B2 * 5/2011 Alkabie ..... F23R 3/04 60/752
2005/0120718 A1 * 6/2005 Markarian ..... F01D 9/023 60/800

* cited by examiner

*Primary Examiner* — Todd E Manahan
*Assistant Examiner* — Todd N Jordan
(74) *Attorney, Agent, or Firm* — Rankin, Hill & Clark LLP

(57) ABSTRACT

In a gas turbine engine, an inside turn duct portion and a nozzle guide vane are engaged together via an engagement part. An axially forward-facing load acting on a reverse flow combustor is transmitted to the vane via the engagement part. Therefore, it is possible to counteract an axially backward-facing load acting on the vane from combustion gas with the axially forward-facing load, thus reducing a bending moment acting on a support part of the vane and enhancing durability. Furthermore, part of the axially forward-facing load acting on the combustor acts on the support part via the vane. The axially forward-facing load acting on the support part of the combustor without via the vane is decreased by the above-mentioned part. Thus, it is possible to reduce bending moments acting on an outside turn duct portion and dome portion of the combustor and enhance durability, thereby preventing degradation of combustion performance.

2 Claims, 3 Drawing Sheets

GAS TURBINE ENGINE

CROSS REFERENCE TO RELATED APPLICATIONS

The present application claims priority under 35 U.S.C. § 119 to Japanese Patent Application No. 2019-41206 filed Mar. 7, 2019 the entire contents of which are hereby incorporated by reference.

BACKGROUND OF THE INVENTION

Field of the Invention

The present invention relates to a gas turbine engine, in which a reverse flow combustor to which air compressed by a compressor is supplied comprises a dome portion, an outside liner portion, an inside liner portion, an outside turn duct portion, and an inside turn duct portion, a nozzle guide vane and the outside turn duct portion being supported on a stationary support body via a support part, and the nozzle guide vane guiding combustion gas generated in the reverse flow combustor to a turbine.

Description of the Related Art

Air compressed by a compressor is supplied to a space encircling a reverse flow combustor of such a gas turbine engine. However, since the air pressure is out of balance, being high to the rear of the reverse flow combustor and low in front thereof, there is the problem that the reverse flow combustor is urged forward in the axial direction due to the difference in pressure, the reverse flow combustor is deformed so as to change the mixing of fuel and air or the flow of gas within the combustor, and aspects of combustion performance such as ignitability, flame stability, and exhaust emissions will be degraded.

A gas turbine engine described in U.S. Pat. No. 6,916,154 B1 includes, in addition to an outside turn duct portion on the radially inner side of a reverse flow combustor and a support part via which a nozzle guide vane is supported on a stationary member, an engagement part via which an outside liner part of the reverse flow combustor is made to engage with the stationary member, this engagement part supporting part of the load urging the reverse flow combustor forward in the axial direction.

The engagement part, via which the outside liner part of the reverse flow combustor is made to engage with the stationary member, is one in which a circular section support pin fixed to the stationary member on the radially outer side of the combustor and extending radially inward is fitted into a circular section receiving hole provided in the outside liner part, and is arranged so that relative movement in the axial direction between the outside liner part and the stationary member is restricted while allowing relative movement in the radial direction.

Since a nozzle guide vane guiding combustion gas generated in the reverse flow combustor to a turbine is urged rearward in the axial direction by means of the combustion gas flowing therein, there is the problem that a bending moment acts on the support part, via which the nozzle guide vane is supported on the stationary member, and the durability is degraded.

Furthermore, when a load urging the reverse flow combustor forward in the axial direction is applied due to the difference in air pressure, since it is necessary for the support pin and the receiving hole to make line contact with each other and support the load via a narrow contact face, wear of the contact face progresses in a short period of time, and there is a possibility that air leakage will be caused and aspects of combustion performance such as ignitability, flame stability, and exhaust emissions will be degraded.

SUMMARY OF THE INVENTION

The present invention has been accomplished in light of the above circumstances, and it is an object thereof to prevent the combustion performance of a reverse flow combustor from being degraded and enhance the durability by reducing a bending moment acting on a support part of a nozzle guide vane, a radially inner portion of an outside turn duct portion, and a dome portion.

In order to achieve the object, according to a first aspect of the present invention, there is provided a gas turbine engine, in which a reverse flow combustor to which air compressed by a compressor is supplied comprises a dome portion, an outside liner portion, an inside liner portion, an outside turn duct portion, and an inside turn duct portion, a nozzle guide vane and the outside turn duct portion being supported on a stationary support body via a support part, and the nozzle guide vane guiding combustion gas generated in the reverse flow combustor to a turbine, wherein the reverse flow combustor has the inside turn duct portion and the nozzle guide vane engaged with each other via an engagement part, and an axially forward facing load acting on the reverse flow combustor is transmitted to the nozzle guide vane via the engagement part.

In accordance with the first aspect, since in the gas turbine engine the reverse flow combustor, to which air compressed by the compressor is supplied, includes the dome portion, the outside liner portion, the inside liner portion, the outside turn duct portion, and the inside turn duct portion, and the outside turn duct portion and the nozzle guide vane, which guides combustion gas generated in the reverse flow combustor to the turbine, are supported on the stationary support body via the support part, a bending moment acts on the outside turn duct portion and the dome portion of the reverse flow combustor, which receive an axially forward facing load due to the compressed air supplied from the compressor and, furthermore, a bending moment acts on the support part of the nozzle guide vane, which receives an axially backward facing load due to the combustion gas discharged from the reverse flow combustor.

Since the inside turn duct portion and the nozzle guide vane are engaged with each other via the engagement part, and the axially forward facing load acting on the reverse flow combustor is transmitted to the nozzle guide vane via the engagement part, it is possible to counteract the axially backward facing load acting on the nozzle guide vane from combustion gas with the above axially forward facing load, thus reducing the bending moment acting on the support part of the nozzle guide vane and enhancing the durability. Furthermore, since part of the axially forward facing load acting on the reverse flow combustor acts on the support part via the nozzle guide vane, the axially forward facing load acting on the support part of the reverse flow combustor without going through the nozzle guide vane is decreased by said part, and it is thus possible to reduce the bending moment acting on the outside turn duct portion and the dome portion of the reverse flow combustor and enhance the durability, thereby preventing aspects of combustion performance such as ignitability, flame stability, and exhaust emissions from being degraded.

According to a second aspect of the present invention, in addition to the first aspect, the support part supports a radially inner portion of the outside turn duct portion and a radially inner portion of the nozzle guide vane on the stationary support body, and the engagement part makes the inside turn duct portion and a radially outer portion of the nozzle guide vane engage with each other.

In accordance with the second aspect, since the support part supports the radially inner portion of the outside turn duct portion and the radially inner portion of the nozzle guide vane on the stationary support body, and the engagement part makes the inside turn duct portion and the radially outer portion of the nozzle guide vane engage with each other, it is possible to dispose the support part and the engagement part at positions close to each other on the radially inner and outer sides of the nozzle guide vane to thus minimize the relative displacement between members due to a difference in thermal expansion, thereby reducing the maximum load acting on the support part and the engagement part and further enhancing the durability.

According to a third aspect of the present invention, in addition to the second aspect, the engagement part comprises an annular first projecting part protruding radially inward from the inside turn duct portion and an annular second projecting part protruding radially outward from the nozzle guide vane.

In accordance with the third aspect, since the engagement part is formed from the annular first projecting part, which protrudes radially inward from the inside turn duct portion, and the annular second projecting part, which protrudes radially outward from the nozzle guide vane, the inside turn duct part and the radially outer portion of the nozzle guide vane are made to abut against each other across a wide area extending over 360°, thus further enhancing the durability.

Note that a low pressure compressor 22 and a high pressure compressor 23 of embodiments correspond to the compressor of the present invention, a high pressure turbine 31 and a low pressure turbine 32 of the embodiments correspond to the turbine of the present invention, a seal ring 51 and a second step portion 29*f* of the embodiments correspond to the first projecting part of the present invention, and a flange portion 42*a* and a second flange portion 42*d* of the embodiments correspond to the second projecting part of the present invention.

The above and other objects, characteristics and advantages of the present invention will be clear from detailed descriptions of the preferred embodiments which will be provided below while referring to the attached drawings.

DESCRIPTION OF THE PREFERRED EMBODIMENTS

In the following description reference numbers corresponding to components of exemplary embodiments are included only for ease of understanding, but the applicant's claims are not limited to the exemplary embodiments or to specific components of the exemplary embodiments.

First Embodiment

A first embodiment of the present invention is explained below by reference to FIG. 1 and FIG. 2. In the present specification, the axial direction is defined as a direction in which a low pressure system shaft 15 and a high pressure system shaft 16 of a gas turbine engine extend, and the radial direction is defined as a direction orthogonal to the axial direction.

Figure 1:
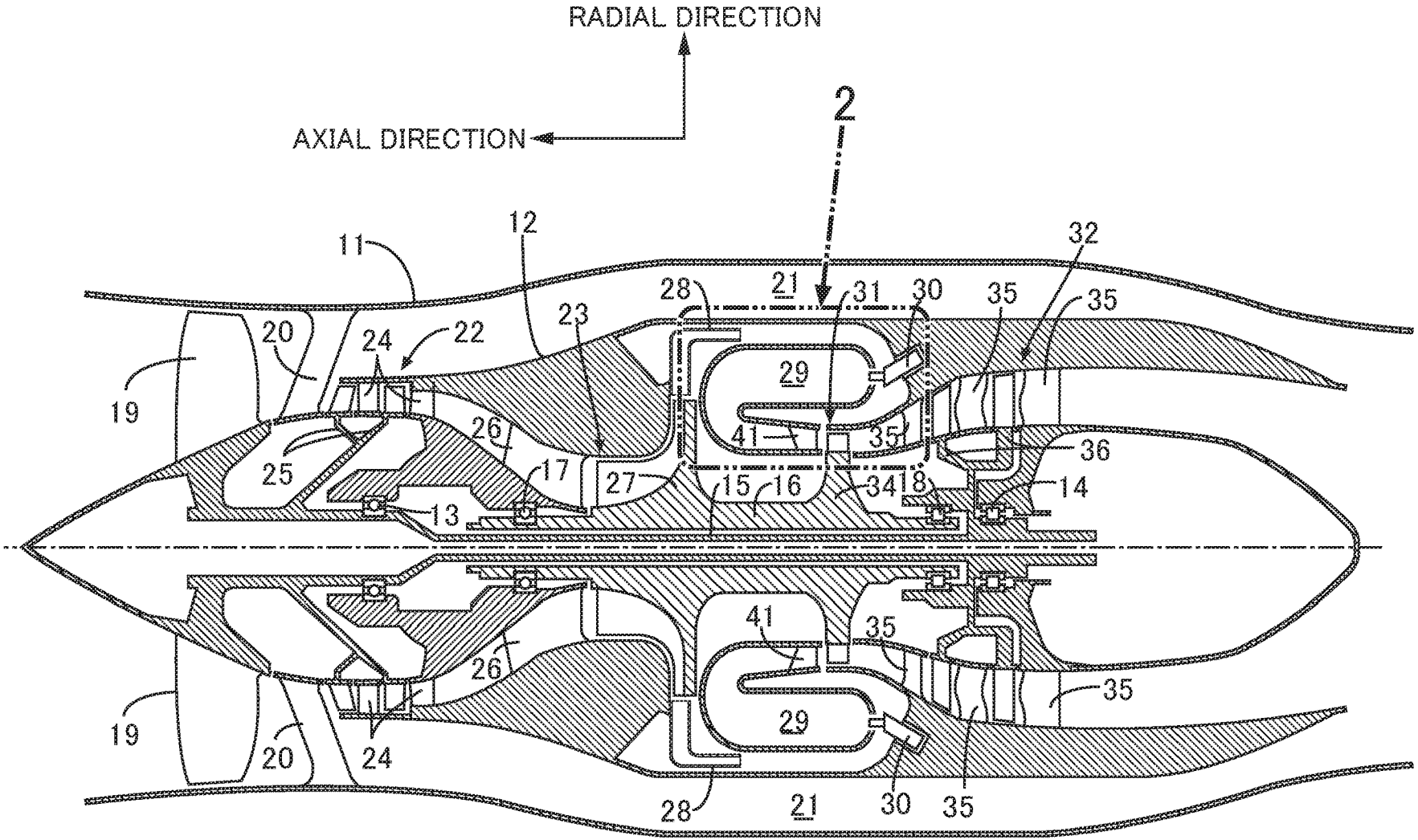
FIG. 1 is a diagram showing the overall structure of a gas turbine engine. (first embodiment)
Figure 2:
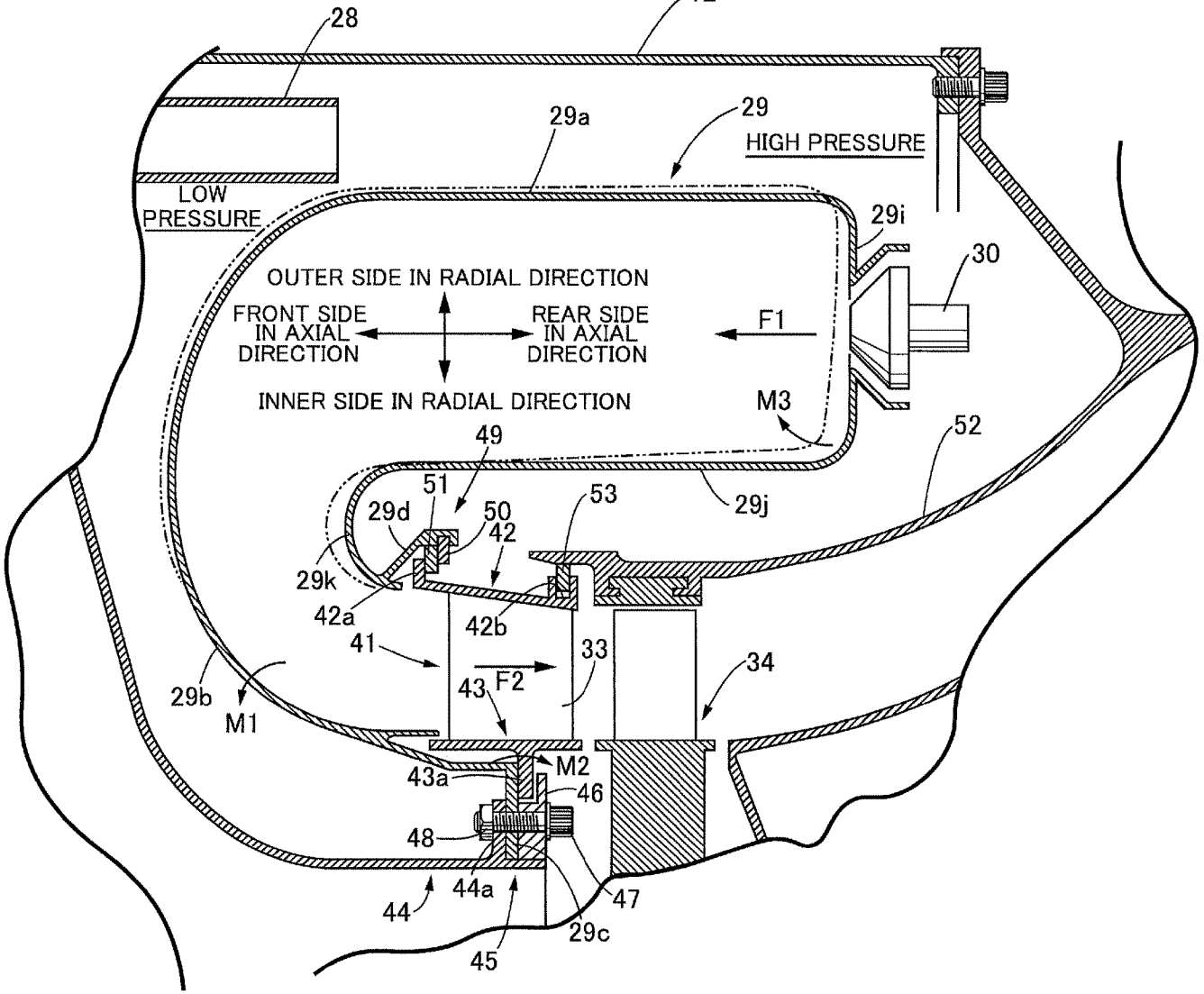
FIG. 2 is an enlarged view of part 2 in FIG. 1. (first embodiment)

As shown in FIG. 1, a gas turbine engine for an airplane to which the present invention is applied includes an outer casing 11 and an inner casing 12, a front part and a rear part of a low pressure system shaft 15 being rotatably supported in the interior of the inner casing 12 via a front first bearing 13 and a rear first bearing 14 respectively. A tubular high pressure system shaft 16 is relatively rotatably fitted around the outer periphery of an axially intermediate part of the low pressure system shaft 15, a front part of the high pressure system shaft 16 is rotatably supported on the inner casing 12 via a front second bearing 17, and a rear part of the high pressure system shaft 16 is relatively rotatably supported on the low pressure system shaft 15 via a rear second bearing 18.

A front fan 19 having a blade tip facing an inner face of the outer casing 11 is fixed to the front end of the low pressure system shaft 15; part of the air sucked in by the front fan 19 passes through stator vanes 20 disposed between the outer casing 11 and the inner casing 12, part thereof then passes through an annular bypass duct 21 formed between the outer casing 11 and the inner casing 12 and is made to issue rearward, and the rest of the air is supplied to an axial low pressure compressor 22 and a centrifugal high pressure compressor 23 disposed in the interior of the inner casing 12.

The low pressure compressor 22 includes stator vanes 24 that are fixed in the interior of the inner casing 12 and a low pressure compressor wheel 25 that includes compressor blades on the outer periphery and is fixed to the low pressure system shaft 15. The high pressure compressor 23 includes stator vanes 26 that are fixed in the interior of the inner casing 12 and a high pressure compressor wheel 27 that includes compressor blades on the outer periphery and is fixed to the high pressure system shaft 16.

A reverse flow combustor 29 is disposed to the rear of a diffuser 28 that is connected to the outer periphery of the high pressure compressor wheel 27, and fuel is injected into the interior of the reverse flow combustor 29 from a fuel injection nozzle 30. The fuel and air are mixed in the interior of the reverse flow combustor 29 and undergo combustion, and the combustion gas thus generated is supplied to a high pressure turbine 31 and a low pressure turbine 32.

The high pressure turbine 31 includes a nozzle guide vane 41 fixed in the interior of the inner casing 12 and a high pressure turbine wheel 34 that includes turbine blades on the outer periphery and is fixed to the high pressure system shaft 16. The low pressure turbine 32 includes nozzle guide vanes 35 fixed in the interior of the inner casing 12 and a low pressure turbine wheel 36 that includes turbine blades on the outer periphery and is fixed to the low pressure system shaft 15.

Therefore, when the high pressure system shaft 16 is driven by means of a starter motor, which is not illustrated, air sucked in by the high pressure compressor wheel 27 is supplied to the reverse flow combustor 29, is mixed with fuel, and undergoes combustion, and the combustion gas thus generated drives the high pressure turbine wheel 34 and the low pressure turbine wheel 36. As a result, the low pressure system shaft 15 and the high pressure system shaft 16 rotate and the front fan 19, the low pressure compressor wheel 25, and the high pressure compressor wheel 27 compress air and supply it to the reverse flow combustor 29, and the gas turbine engine thus continues to run even when the starter motor is stopped.

While the gas turbine engine is running, part of the air sucked in by the front fan 19 passes through the bypass duct 21, is made to issue rearward, and generates the main thrust, particularly at a time of low speed flying. The rest of the air sucked in by the front fan 19 is supplied to the reverse flow combustor 29, is mixed with fuel, undergoes combustion, drives the low pressure system shaft 15 and the high pressure system shaft 16, is then made to issue rearward, and generates a thrust.

The support structure of the reverse flow combustor 29 is now explained by reference to FIG. 2.

The outer shell of the reverse flow combustor 29 includes a dome portion 29*i*, an outside liner portion 29*a*, an inside liner portion 29*j*, an outside turn duct portion 29*b*, and an inside turn duct portion 29*k*; the outside liner portion 29*a* and the inside liner portion 29*j* extend forward from the dome portion 29*i*, on which the fuel injection nozzle 30 is provided, and the outside turn duct portion 29*b* and the inside turn duct portion 29*k* extend rearward from the front ends of the outside liner portion 29*a* and the inside liner portion 29*j* while bending through 180° and are connected to the nozzle guide vane 41. The annular nozzle guide vane 41, which is disposed in an outlet of the reverse flow combustor 29, includes an outer band 42, an inner band 43 positioned on the inner peripheral side of the outer band 42, and a plurality of guide vanes 33 providing a connection between the outer band 42 and the inner band 43.

A support part 45 supporting a radially inner portion of the outside turn duct portion 29*b* of the reverse flow combustor 29 and the inner band 43 of the nozzle guide vane 41 on a stationary support body 44 forming part of the inner casing 12 is formed by screwing, into a nut 48, a bolt 47 extending through an annular flange portion 44*a* extending to the radially outer side of the stationary support body 44, an annular flange portion 29*c* extending to the radially inner side of the outside turn duct portion 29*b* of the reverse flow combustor 29, an annular flange portion 43*a* extending to the radially inner side of the inner band 43 of the nozzle guide vane 41, and an annular retaining ring 46, which are superimposed in the fore-and-aft direction. The annular flange portion 43*a*, which extends to the radially inner side of the inner band 43 of the nozzle guide vane 41, is floatingly supported in a space formed from the flange portion 29*c* and the retaining ring 46.

On the other hand, the inside turn duct portion 29*k* of the reverse flow combustor 29 and the outer band 42 of the nozzle guide vane 41 engage with each other via an engagement part 49. That is, the engagement part 49 includes an annular flange portion 29*d* extending radially outward from the inside turn duct portion 29*k* of the reverse flow combustor 29, an annular flange portion 42*a* extending radially outward from the front end of the outer band 42 of the nozzle guide vane 41, a clip 50 supported on an inner peripheral face of the flange portion 29*d* of the inside turn duct portion 29*k*, and a seal ring 51 sandwiched between the flange portion 42*a* of the outer band 42 and the clip 50 in the fore-and-aft direction and abutting against the inner peripheral face of the flange portion 29*d* of the inside turn duct portion 29*k*.

A seal ring 53 fitted into a seal ring groove 42*b* formed in the rear end of the outer band 42 of the nozzle guide vane 41 abuts against a front end part of a turbine case 52 covering a radially outer side of the high pressure turbine wheel 34, which is positioned to the rear of the nozzle guide vane 41, so as to be slidable in the axial direction.

The operation of the embodiment of the present invention having the above arrangement is now explained.

The rear of the space encircling the reverse flow combustor 29 is blocked by the turbine case 52, and since high pressure air issues rearward from the diffuser 28 toward the turbine case 52, the rear of the space encircling the reverse flow combustor 29 attains a high pressure, and the front thereof attains a low pressure. Due to such a difference in pressure the reverse flow combustor 29 receives a forward facing load F1 and attempts to deform forward as shown by a double-dotted broken line in FIG. 2, and there are therefore the problems that bending moments M1 and M3 act on the radially inner portion of the outside turn duct portion 29*b* and the dome portion 29*i* to thus degrade the durability, and deformation of the reverse flow combustor 29 degrades the combustion performance.

Furthermore, since an axially backward facing load F2 acts on the nozzle guide vane 41, through which combustion gas flowing out from the reverse flow combustor 29 passes, there is the problem that a bending moment M2 acts on the base of the flange portion 43*a* of the inner band 43 of the nozzle guide vane 41, thus degrading the durability.

However, in accordance with the present embodiment, since in the engagement part 49 the seal ring 51, which is latched to the flange portion 29*d* of the inside turn duct portion 29*k* of the reverse flow combustor 29 by means of the clip 50, abuts against the flange portion 42*a* of the outer band 42 of the nozzle guide vane 41, it is possible to counteract the axially backward facing load F2 acting on the nozzle guide vane 41 with part of the axially forward facing load F1 acting on the reverse flow combustor 29. As a result, it is possible to reduce the bending moment M2 acting on the base of the flange portion 43*a* of the inner band 43 of the nozzle guide vane 41 to thus enhance the durability of the inner band 43, to reduce the forward facing load transmitted to the radially inner portion of the outside turn duct portion 29*b* and the dome portion 29*i* of the reverse flow combustor 29 by a portion corresponding to the load transmitted from the reverse flow combustor 29 to the support part 45 via the nozzle guide vane 41, to reduce the bending moments M1 and M3 acting on the radially inner portion of the outside turn duct portion 29*b* and the dome portion 29*i* to thus enhance the durability, and to suppress deformation of the reverse flow combustor 29 to thus prevent the combustion performance from being degraded.

Furthermore, since the support part 45 and the engagement part 49 are disposed at positions close to each other on the radially inner and outer sides of the nozzle guide vane 41, it is possible to sufficiently reduce displacement in the axial direction and the radial direction between members due to a difference in thermal expansion. Not only does this enable the maximum load acting on the support part 45 and the engagement part 49 to be reduced to thus further enhance the durability of the reverse flow combustor 29 and the nozzle guide vane 41, but also enables wear of the engagement part 49 to be suppressed to thus reliably prevent air from leaking.

Moreover, since the engagement part 49 includes the seal ring 51, which is a first projecting part protruding radially inward from the inside turn duct portion 29*k* of the reverse flow combustor 29, and the flange portion 42*a*, which is a second projecting part protruding radially outward from the outer band 42 of the nozzle guide vane 41, it is possible to reliably engage the inside turn duct portion 29*k* of the reverse flow combustor 29 and the outer band 42 of the nozzle guide vane 41 with a simple structure.

Furthermore, in the arrangement described in U.S. Pat. No. 6,916,154 B1 mentioned above, since the support pin and the receiving hole abut against each other via a linear narrow abutment face, the abutment face easily wears and there is a possibility that the durability will be degraded, but in accordance with the present embodiment since in the engagement part 49 the seal ring 51 and the flange portion 42*a* abut against each other via an annular wide area extending over 360°, wear of the abutment face is minimized.

Second Embodiment

Figure 3:
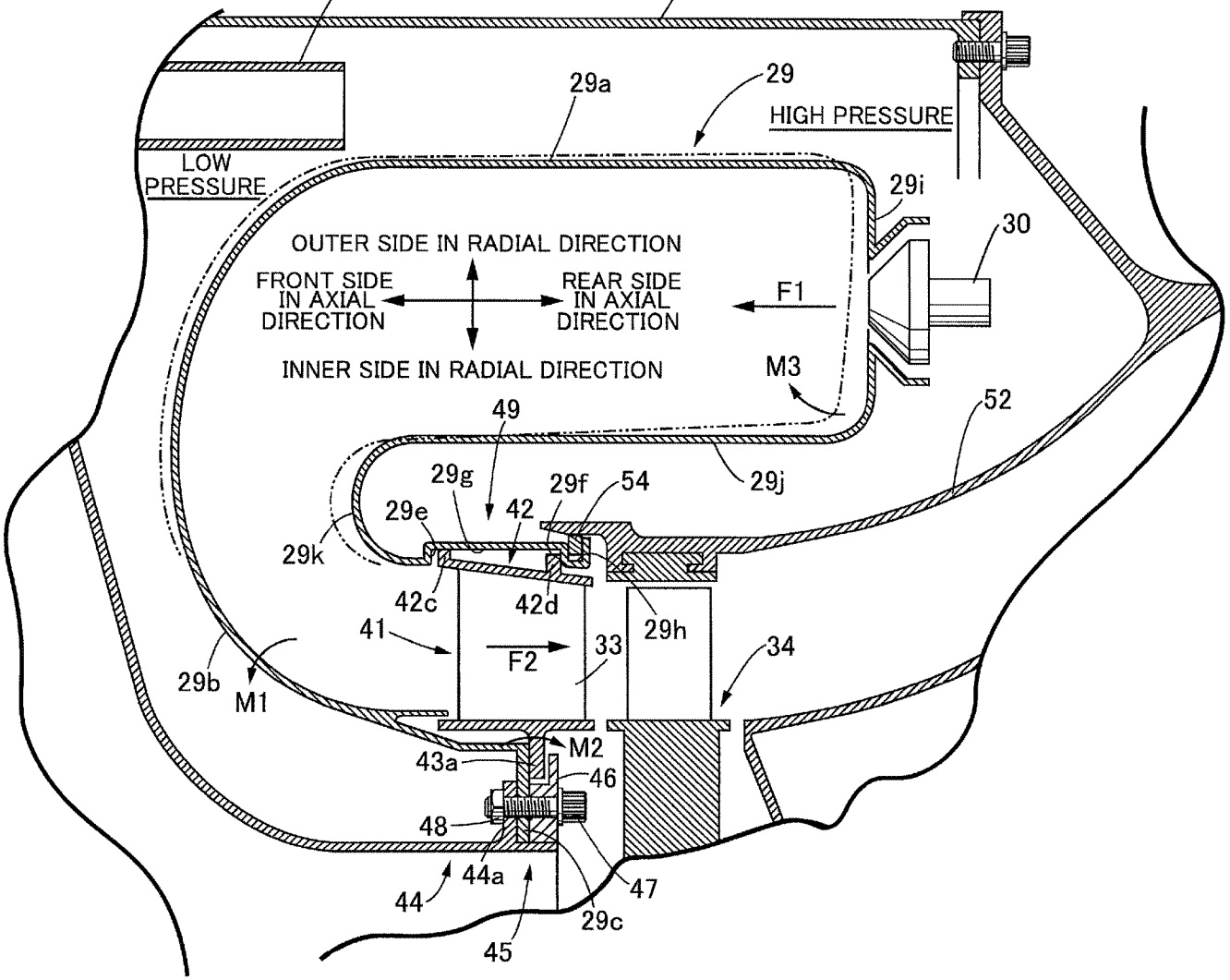
FIG. 3 is an enlarged view of part 2 in FIG. 1. (second embodiment)

A second embodiment of the present invention is now explained by reference to FIG. 3.

The nozzle guide vane 41 of the first embodiment is formed from a single annular member or a plurality of annular members in which a plurality of fan-shaped segments are connected in the circumferential direction, but a nozzle guide vane 41 of the second embodiment is formed into an annular shape by connecting a plurality of fan-shaped segments in the circumferential direction. An engagement part 49 of the second embodiment is different from that of the first embodiment in terms of the structure. That is, formed on the radially outer side of the outside turn duct portion 29*b* of the reverse flow combustor 29 are the outside liner portion 29*a*, the dome portion 29*i*, the inside liner portion 29*j*, the inside turn duct portion 29*k*, and an annular recess portion 29*g* that is recessed radially outward via a first step portion 29*e* and a second step portion 29*f*, and formed to the rear of the annular recess portion 29*g* is a seal ring groove 29*h* that opens radially outward. A first flange portion 42*c* on the front side and a second flange portion 42*d* on the rear side of the outer band 42 of the nozzle guide vane 41 are fitted into the annular recess portion 29*g* of the inside turn duct portion 29*k*, and a seal ring 54 retained by the seal ring groove 29*h* abuts against an inner peripheral face of the turbine case 52 so that it can slide in the fore-and-aft direction.

In accordance with the present embodiment also, the axially backward facing load F2 acting on the nozzle guide vane 41 due to combustion gas issuing from the reverse flow combustor 29 can be counteracted by the axially forward facing load F1 transmitted from the reverse flow combustor 29 to the nozzle guide vane 41 via the engagement part 49, thus reducing the bending moment M2 acting on the base of the flange portion 43*a* of the inner band 43 of the nozzle guide vane 41 and thereby enhancing the durability of the inner band 43. Furthermore, it is possible to reduce the load F1 transmitted to the radially inner portion of the outside turn duct portion 29*b* and the dome portion 29*i* of the reverse flow combustor 29 by a portion corresponding to the load transmitted from the reverse flow combustor 29 to the support part 45 via the nozzle guide vane 41, to reduce the bending moments M1 and M3 acting on the radially inner portion of the outside turn duct portion 29*b* and the dome portion 29*i* to thus enhance the durability, and to prevent deformation of the reverse flow combustor 29 to thus prevent the combustion performance from being degraded.

Moreover, since the support part 45 and the engagement part 49 are disposed at positions close to each other on the radially inner and outer sides of the nozzle guide vane 41, it is possible to sufficiently reduce the relative displacement between members due to a difference in thermal expansion. Not only does this enable the maximum load acting on the support part 45 and the engagement part 49 to be reduced to thus further enhance the durability of the reverse flow combustor 29 and the nozzle guide vane 41, but this can also reliably prevent air leakage due to wear of the engagement part 49.

Furthermore, since the engagement part 49 includes the second step portion 29*f*, which is the first projecting part protruding radially inward from the inside turn duct portion 29*k* of the reverse flow combustor 29, and the second flange portion 42*d*, which is the second projecting part protruding radially outward from the outer band 42 of the nozzle guide vane 41, it is possible to reliably engage the inside turn duct portion 29*k* of the reverse flow combustor 29 and the outer band 42 of the nozzle guide vane 41 with a simple structure.

The nozzle guide vane 41, which is formed into an annular shape by connecting the plurality of fan-shaped segments in the circumferential direction, is retained by being fitted into the annular recess portion 29*g* formed between the first step portion 29*e* and the second step portion 29*f* of the reverse flow combustor 29, and it is therefore possible to strongly integrate the plurality of fan-shaped segments and maintain the shape.

Embodiments of the present invention are explained above, but the present invention may be modified in a variety of ways as long as the modifications do not depart from the gist of the present invention.

For example, the first projecting part and the second projecting part of the present invention are not limited to the seal ring 51 and the flange portion 42*a* of the first embodiment, and are not limited to the second step portion 29*f* and the second flange portion 42*d* of the second embodiment either.

What is claimed is:

1. A gas turbine engine, in which a reverse flow combustor to which air compressed by a compressor is supplied comprises a dome portion, an outside liner portion, an inside liner portion, an outside turn duct portion, and an inside turn duct portion, a nozzle guide vane and the outside turn duct portion being supported on a stationary support body via a support part, and the nozzle guide vane guiding combustion gas generated in the reverse flow combustor to a turbine, wherein the reverse flow combustor has the inside turn duct portion and the nozzle guide vane engaged with each other via an engagement part that makes the inside turn duct portion and a radially outer portion of the nozzle guide vane engage with each other, an axially forward facing load acting on the reverse flow combustor is transmitted to the nozzle guide vane via the engagement part, the engagement part comprises:

an inside turn duct annular flange portion extending radially outward from the inside turn duct portion;

a nozzle guide portion annular flange portion extending radially outward from a radially outer band of the nozzle guide vane;

a clip supported on an inner peripheral face of the inside turn duct annular flange portion; and a seal ring sandwiched between the nozzle guide portion annular flange portion and the clip in a fore-and-aft direction and abutting against the inner peripheral face of the inside turn duct flange portion.

2. The gas turbine engine according to claim 1, wherein the support part supports a radially inner portion of the outside turn duct portion and a radially inner portion of the nozzle guide vane on the stationary support body.

* * * * *